United States Patent [19]

Otting

[11] Patent Number: 4,501,038

[45] Date of Patent: Feb. 26, 1985

[54] METHOD AND APPARATUS FOR SPRAY TREATING TEXTILE MATERIAL

[75] Inventor: Billy J. Otting, Lafayette, Ga.

[73] Assignee: Otting International, Inc., Lafayette, Ga.

[21] Appl. No.: 391,468

[22] Filed: Jun. 23, 1982

[51] Int. Cl.[3] ..... D06B 1/02

[52] U.S. Cl. ..... 8/151; 8/158; 8/477; 68/205 R

[58] Field of Search ..... 8/477, 149.1, 158, 151, 8/149.2; 68/5 D, 5 E, 200, 205 R

[56] References Cited

U.S. PATENT DOCUMENTS

| | | | |
|---|---|---|---|
| 1,683,687 | 9/1928 | Mijer | 8/149.2 |
| 2,218,811 | 10/1940 | Chaussabel | 68/205 R |
| 2,234,914 | 3/1941 | James | 68/205 R |
| 3,042,573 | 7/1962 | Roberts | 8/477 X |
| 3,256,581 | 6/1966 | Thal et al. | 26/2 R |
| 3,271,102 | 9/1966 | Morgan | 68/205 R X |
| 3,326,711 | 6/1967 | Spencer | 427/176 |
| 3,785,179 | 1/1974 | Davis et al. | 68/5 D |
| 3,969,780 | 7/1976 | Henderson | 68/205 R X |
| 4,061,001 | 12/1977 | von der Eltz et al. | 68/200 |
| 4,118,526 | 10/1978 | Gregorian et al. | 427/350 |
| 4,141,231 | 2/1979 | Kudlich | 68/205 R |
| 4,275,683 | 6/1981 | Kutz et al. | 68/205 R X |
| 4,282,729 | 8/1981 | Smith | 68/205 R |

FOREIGN PATENT DOCUMENTS

WO81/01161 4/1981 PCT Int'l Appl. ..... 68/205 R

OTHER PUBLICATIONS

"A New Method of Foam Application for the Continuous Dyeing of Carpets", by R. Weber et al., 2 p. reprint from Chemiefasern Textilindustrie, 30/82 (1980).

"Carpet Coloring Technology: a Strong Outlook", by Stanley M. Suchecki, pp. 51–54, 56, 58, and 60 of Textile Industries, May 1979.

*Primary Examiner*—Philip R. Coe

*Attorney, Agent, or Firm*—Kerkam, Stowell, Kondracki & Clarke

[57] ABSTRACT

A method of carpet treating and apparatus for the dyeing of intricate patterns is provided wherein a plurality of spray nozzles are disposed in a spray line transverse to the direction of movement of a carpet. Each spray nozzle is connected to a mixing chamber where air and treating liquid preferably dye, are applied at selected pressures between 0 and 60 p.s.i. Depending on the relative pressure of the air and liquid dye, the mixture is caused to be either atomized or foamed through the spray nozzles onto the face of a moving carpet web. Each nozzle is connected to its own separate mixing chamber the input of which are controlled through a corresponding control valve which turns on and off the spray nozzle by opening and closing a corresponding gas valve and corresponding dye valve.

33 Claims, 4 Drawing Figures

METHOD AND APPARATUS FOR SPRAY TREATING TEXTILE MATERIAL

CROSS REFERENCE TO RELATED APPLICATIONS

Valve arrangements described herein are more particularly described and claimed in U.S. patent application Ser. No. 086,392, filed Oct. 18, 1979 by the present inventor, and entitled "Pinch Tube Valve", now abandoned in favor of continuation application Ser. No. 279,954, filed July 1, 1981. The use of such valve arrangements are further detailed in U.S. applications "Jet Pattern Dyeing of Material, Particularly Carpet", Ser. No. 085,943, filed Oct. 18, 1979 by the present inventor, now abandoned in favor of Ser. No. 237,577, filed Feb. 24, 1981, now U.S. Pat. No. 4,341,098, and "Pattern Dyeing of Textile Materials Such as Carpet", Ser. No. 156,624, filed June 6, 1980, now abandoned, by the present inventor and Alfred Clifford. These aforementioned applications are assigned to the assignee of the present invention and are hereby incorporated by reference.

BACKGROUND OF THE INVENTION

This invention relates to the treating of textile material. More specifically, this invention relates to the spray dyeing of textile material, such as carpets.

Numerous techniques have been used for treating or dyeing textile material such as carpet. A common technique is the well known and popular "TAK" process wherein dye is dropped or splattered onto the carpet web previously flooded with gum. This is disadvantageous in that it requires a great amount of gum, which in turn produces a large amount of effluent and necessitates a great amount of energy for steam setting the dye and for drying the carpet. Additionally, the use of a roller and doctor blade or similar types of dye applicating arrangements for applying dye and the period for drying are limiting factors in terms of the speed at which the carpet is conveyed through the system and consequently limit the rate of carpet production.

Foam dyeing represents an attempt to overcome several of the above-mentioned disadvantages common to most dyeing processes. Foam dyeing generally uses foam generators and foam stabilizers mixed with the dye. The dye and any ancillary additives are mechanically foamed in a conventional foamer. The prepared foam may then be metered onto the face of a carpet after which vacuuming and/or padding may be used to collapse the foam causing the dye to be uniformly distributed on the carpet pile.

Although such prior art techniques have been generally useful in avoiding several of the disadvantages associated with conventional dyeing techniques, they are often limited to the production of patterns having random dyeing affects. Generally, such techniques have been unsuitable for patterns requiring sharp resolution for intricate or detailed patterns. Further, the requirement for adding foam generators and foam stabilizers adds to the production costs of such techniques.

OBJECTS

It is a general object of the present invention to provide a new and improved method and apparatus for treating textile material.

Another object of the present invention is to provide for the dyeing of textile material with a relatively low amount of water and energy consumption.

A further object of the present invention is to provide for the dyeing of textile materials with only a minimal amount of effluent produced.

A still further object of the present invention is to provide for the dyeing of textile materials with sharp patterns having a high degree of resolution.

Yet another object of the present invention is to provide for the dyeing of textile materials wherein the dye is used in a highly efficient manner with very little of the dye wasted as effluent.

Another object of the present invention is to minimize the drying time of a dyeing process so as to allow increased rate of production.

Yet another object of the present invention is to provide for the dyeing of textile materials with patterns which may be changed very quickly.

SUMMARY OF THE INVENTION

These and other objects of the present invention which will become apparent as the description proceeds are realized by a method and apparatus for treating textile web wherein liquid and air are applied at preselected pressures into a mixing chamber. Depending on the relative pressures of the liquid and air, the mixture is caused to be atomized or foamed through an exit nozzle onto the face of the textile web. A plurality of nozzles, each with its own mixing chamber, are spaced above and across the face of the web so that the entire width of the web is treated as the web is conveyed past the nozzles. Each chamber is independently valved such that high pattern resolution may be achieved and a plurality of such treating stations may be successively arranged along the path of travel of the carpet web.

More specifically, the method of the present invention comprises mixing gas and a treating fluid in a plurality of mixing zones, each mixing zone receiving its gas and treating fluid respectively by means of a corresponding one of a selectively controlled gas valve and a corresponding one of a selectively controlled liquid valve spraying the mixed gas and treating fluid from a plurality of spray nozzles onto a moving textile web; and selectively controlling the valves to control application of the spray from the spray nozzles such that the minimum amount of material is applied onto the textile web to complete the desired treatment. The method further includes the step of supplying control signals to a plurality of control valves, each control valve supplying control fluid to a corresponding one of the gas valves and a corresponding one of the liquid valves, and wherein the control fluid opens and closes the gas and liquid valves to control the spray applied from the spray nozzles. The closing of the gas valves and dye valves is accomplished by having the valve pinch a flexible tube running through the valve. Controlling the relative pressures of the air and liquid applied controls the extent of atomization or foaming of the applied spray.

The apparatus for treating a continuously moving textile material according to the present invention comprises:

a plurality of gas valves; a plurality of treating fluid or dye valves, each dye valve corresponding on a one-to-one basis with one of the gas valves; a plurality of mixing zones, each mixing zone being connected to receive and mix gas and treating fluid or dye, as the case may be, respectively, from a corresponding one of the gas valves and a corresponding one of the treating fluid valves; a plurality of spray nozzles, each spray nozzle being connected for receiving the mixed gas and fluid from a corresponding one of the mixing zones; and control means for selectively opening and closing the gas valves and treating fluid valves to turn on and off spray from the spray nozzles such that a pattern may be dyed onto the textile material. The control means comprises a plurality of control valves, each control valve supplying control fluid to a corresponding one of the gas valves and to a corresponding one of the treating fluid valves, and wherein the control fluid opens and closes the gas valves and treating fluid valves to turn on and off spray from the spray nozzles. Each of the gas valves and treating fluid valves is a pinch valve which cuts off flow by pinching a flexible tube carrying gas or treating fluid to one of the mixing zones. Each of the gas valves and treating fluid valves further includes a spring-biased piston and a freely rotatable ball moveable by movement of the piston to cut off fluid flow by pinching the flexible tube. A plurality of support members, each support member supporting a plurality of gas valves and a plurality of corresponding treating fluid valves, is provided. Each support member includes control fluid passages for allowing control fluid flow from a control valve to the corresponding gas valve and corresponding treating fluid valve. The spray nozzles are stationary, and disposed in a spray line transverse to the direction of movement of the textile web, and all spray nozzles spray in the same direction. The mixing zones are chambers with the gas entering the chamber in the same direction as mixed gas and treating fluid exists from the chamber to the spray nozzles and with the treating fluid entering the chamber perpendicular to the gas. In a preferred embodiment, the treating fluid is a dye.

BRIEF DESCRIPTION OF THE DRAWINGS

These and other features of the present invention will be best understood when considered in conjunction with the accompanying drawings wherein like characters represent like parts throughout and.

DETAILED DESCRIPTION OF THE PREFERRED EMBODIMENTS

Figure 1:
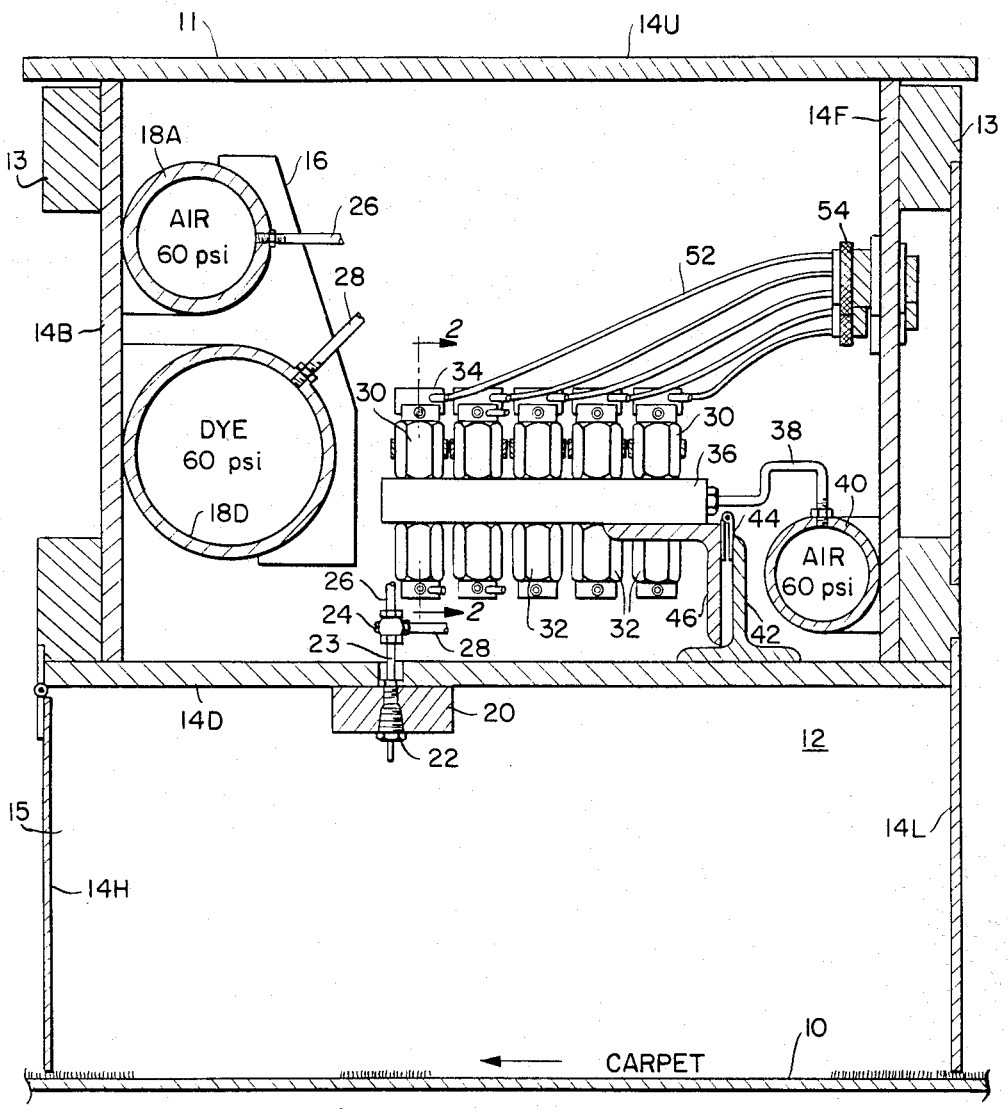
FIG. 1 shows a side view of a first embodiment of the present invention with several parts shown in cross section.
Figure 2:
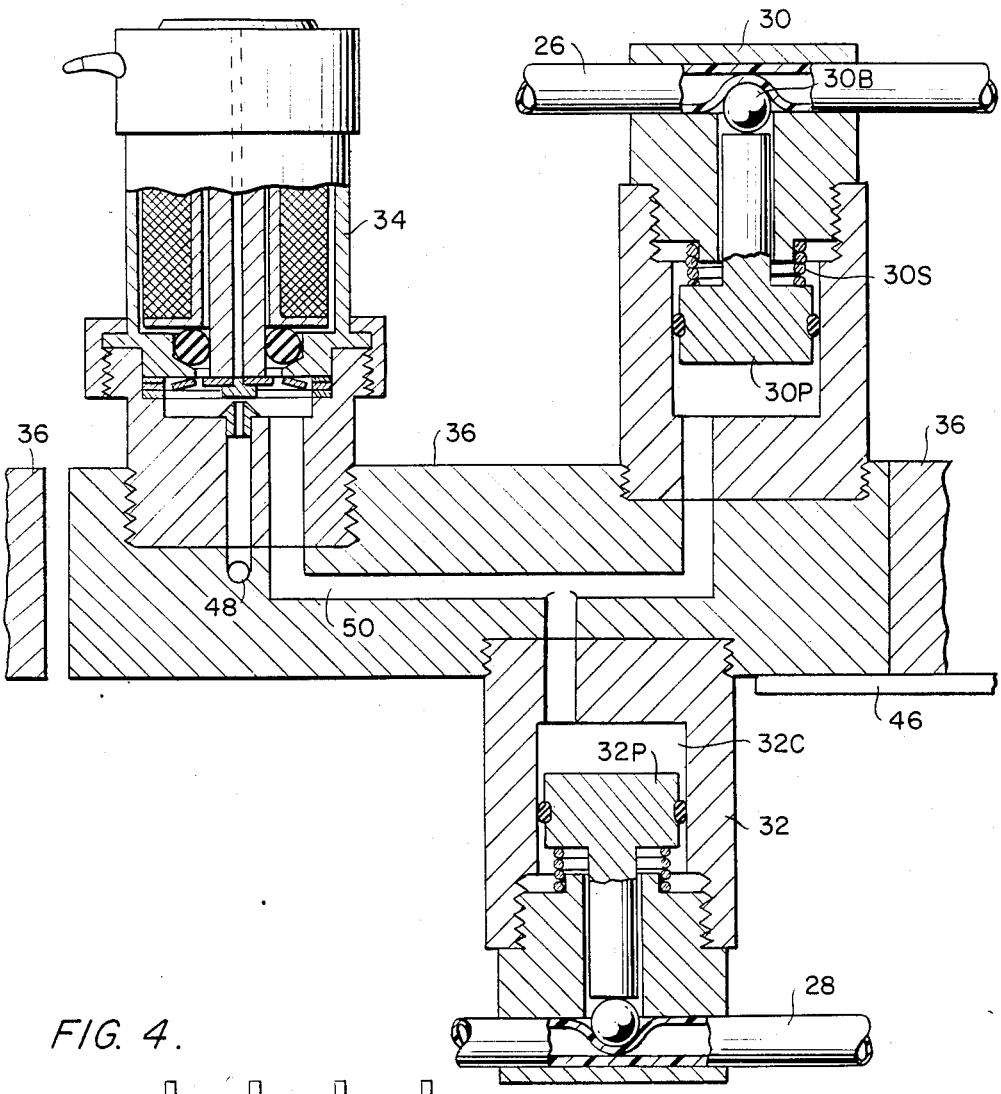
FIG. 2 shows a cross section view along lines 2—2 of FIG. 1.

Turning now to FIGS. 1 and 2, a first embodiment of the present invention will be discussed. FIG. 1 shows a side view of the present invention with several parts shown in cross section, whereas FIG. 2 shows a cross section view taken along lines 2—2 of FIG. 1 to illustrate operation of various valves used with the present invention.

A carpet 10 moves in the direction shown below a dyeing station 12 according to the present invention. It will be readily appreciated that a dyeing station similar to 12 may be located either upstream or downstream from 12 to dye the carpet with a different color, thereby attaining multi-color effects. Since such other dye stations will be identical in construction to dye station 12 except that it will be supplied with a different color dye, it obviously need not be discussed in detail.

More generally, dye station 12 could be a treating station in which case spray liquids other than dye could be used. For example, gums or other substances used for treating textiles may be employed in place of, or in addition to, dye. Since the present invention is especially well-suited to dyeing the discussion which follows will emphasize the use of dye as the spray liquid.

It will also be appreciated, that dyeing station 12 extends transversely of the width of a carpet web driven continuously through several treating stations of a conventional carpet dyeing system. Web 10 may, for example, be fifteen feet in width and is subjected to several treating steps during the process all of which are well known.

The dye station 12 according to the present invention includes an applicator head having upper, lower, front, and back walls labled 14U, 14D, 14F and 14B respectively. Corner blocks 13 as shown and bolts (not shown) may be used to hold the walls together and provide additional rigidity to the structure. Additionally, a lower wall 14L and lower hinged wall or skirt 14H are situated as shown to define a closed area 15 between the carpet and application head. If desired side skirts, not shown, may also be included to completely enclose the area over the carpet 10 just below the head. Support 16 is attached to wall 14B for supporting a pressurized air source reservoir 18A and pressurized dye source reservoir 18D, each of which is generally cylindrical extending perpendicular to the plane of the view of FIG. 1, i.e. transverse to the direction of travel of the carpet web 10.

A spray nozzle support block 20, which is rectangular in cross section as shown and extends across the width of the carpet web is mounted to the underside of lower wall 14D and supports spray nozzles 22. Although only one spray nozzle is shown in FIG. 1, it is to be understood that a number of identical spray nozzles 22 will extend in a line perpendicular to the plane of the view of FIG. 1 and transverse to the direction of travel of the carpet web. Preferably, the center-to-center distance between adjacent spray nozzles 22 threaded into block 20 is one-half inch. Each of the spray nozzles 22 is connected to a mixing zone or chamber 24 by a connector tube 23 and each chamber 24 is in turn connected to a flexible gas supply tube 26 and a flexible dye supply tube 28. The interior of mixing chamber 24 may be a simple parallelepiped with exterior access holes, or nipples allowing connection of tubes 23,26 and 28 dye and air in and the mixture of dye and air out. The chamber could, for example, be about a ½" cube. For simplicity's sake, the gas or air supply tube 26 and the dye supply tube 28 are broken away. All of the mixing chambers 24, air supply tubes 26, and dye tubes 28 will be disposed within the applicator head 11. For a 15 foot width head one can readily appreciate that interconnecting 260 mixing chambers 26 requires an enormous amount of tubing to be confined within the walls defining the head. As shown, the air tubes 26 are connected to the air reservoir 18A, whereas the dye tubes 28 are connected to the dye reservoirs 18D.

Each of the air tubes 26, which is associated with a corresponding one of mixing zone 24 and a corresponding one of spray nozzle 22, also is associated with a corresponding one of air or gas valves 30. Likewise, each of the dye tubes 28, is associated on a one-to-one basis with a mixing zone 24 and a corresponding spray nozzle 22, and also corresponds on a one-to-one basis with a control valve 34. Thus, each associated gas valve 30, dye valve 32 and control valve 34 forms a valve control set and as shown in FIG. 1, five such control sets of corresponding gas valves 30, dye valves 32, and control valves 34 are mounted to an individual support member block 36 forming a modular unit. A number of such identically constructed modular support member blocks 36 are supported interiorly on applicator head 17 on cross bracket 46. Each of the support member blocks 36 have interior fluid channels adapted to be connected to a control fluid source or reservoir 40 by way of tube 38. The control fluid may be air at 60 p.s.i. pressure for example. If the air reservoir 18A which is used for spraying the dye is of the same pressure, then the tube 38 may simply connect to cylinder 18A. Alternately, a compressor or other source of pressurized air for control fluid tube 40 may simply be the same source of pressurized air which supplies 18A.

Each of the support member blocks 36 is mounted to a support bracket 46 which is connected by hinge 44 to mounting piece 42. Each of the numerous support member blocks 36 may have a separate support bracket 46 or, alternately, as shown in FIG. 2, two adjacent support member blocks 36 may be supported by the same bracket 46. The mounting piece 42 may simply extend along the full axial length of the applicator head 11 parallel adjacent the line of spray nozzles 22. The actual location is selected to minimize the length of connecting tubes.

As best shown in FIG. 2, the control fluid air which enters the support member block 36 through tube 38 is distributed to the associated five control valves 34 by a control fluid passage 48. Depending upon whether the solenoid of control valve 34 is actuated, control fluid may either be blocked or flow through a particular control valve 34 into the corresponding gas valve 30 and corresponding dye valve 32 by way of control fluid passage 50. There would, of course, be five control fluid passages 50 in each support member 36 corresponding to each set of a a gas valve 30, a dye valve 32, and a control valve 34.

The operation of the valves such as the gas valves and each dye valve 32 is discussed in detail in the above-identified and incorporated by reference patent application Ser. No. 279,954. However, the operation of a gas valve 30 will be briefly discussed herein, it being understood that each of the dye valves 32 functions in the same manner. When the solenoid valve 34 is actuated, control fluid such as pressurized air is allowed to flow from passage 48 into passage 50 and into valve chambers 30C and 32C. The piston 30P will be displaced against the bias of spring 30S. This will cause the freely rotating ball 30B to squeeze the flexible gas tube 26, thereby cutting off flow of gas into the corresponding mixing chamber 24. In similar fashion, the presence of pressurized control fluid in chamber 32C will act on piston 32P simultaneously cutting off the flow of dye to the corresponding mixing chamber 24 by pinching the flexible dye tube 28. Obviously, this will in turn cut off the spray output of the corresponding spray nozzle 22.

Each of the solenoid control valves 34 is turned on and off by electrical signals on lines 52 connected to an external control via plug 54 mounted in front wall 14F. A single plug 54 may be used to interconnect all five of the solenoid control valves 34 on a particular modular support member block 36. Alternately, a plug 54 may be wired to control solenoid control valves 34 on two or more adjacent support member blocks 36.

Figure 4:
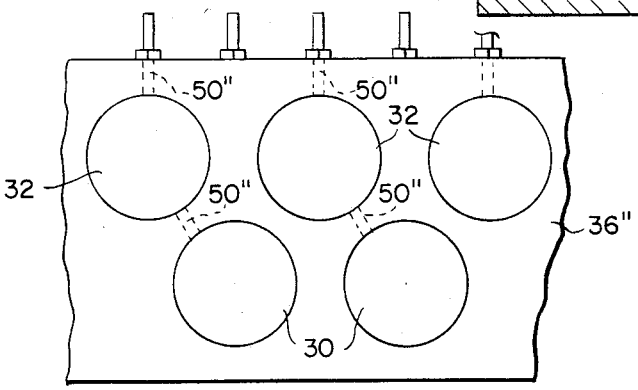
FIG. 4 shows a view along lines 4—4 of FIG. 3, but with a slight modification to parts of FIG. 3.
Figure 3:
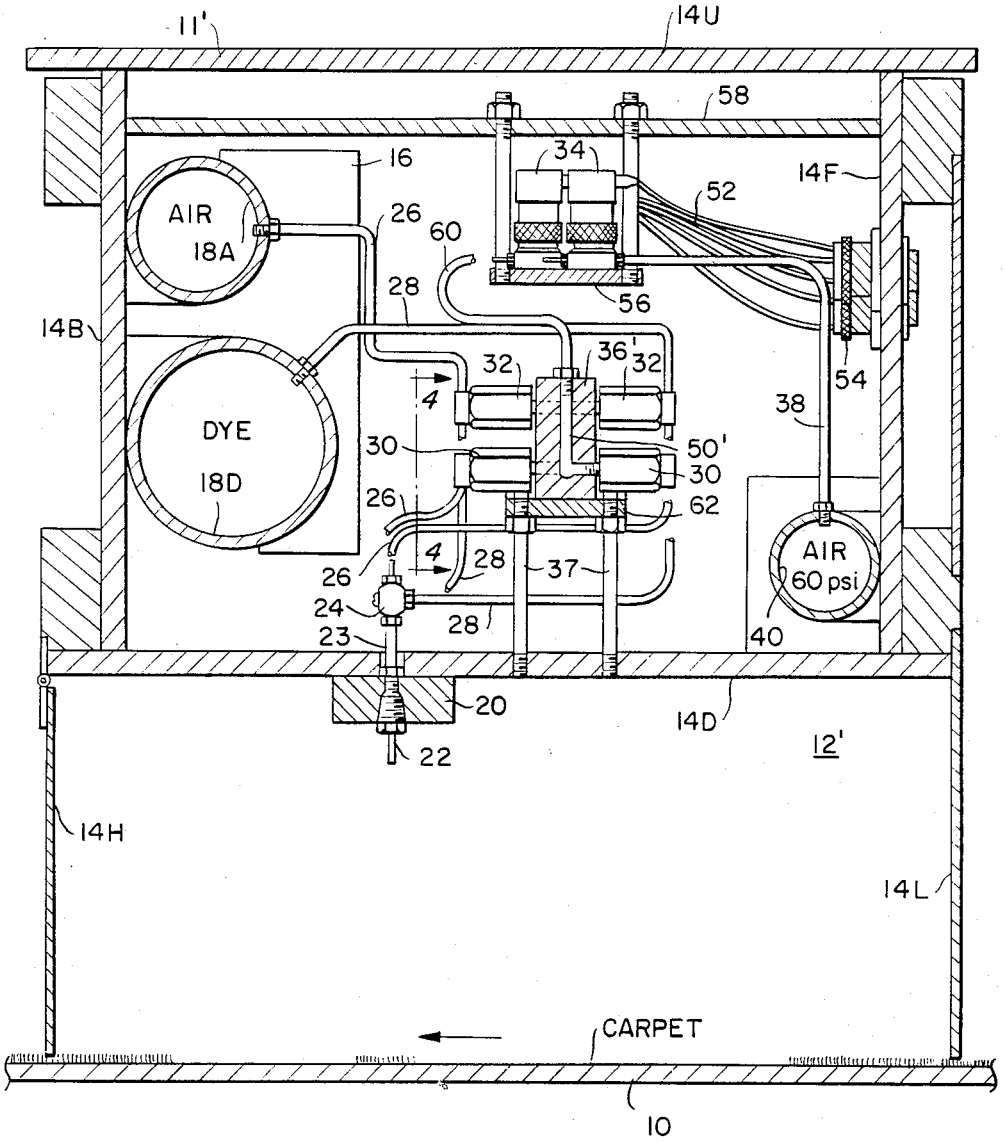
FIG. 3 shows an alternate embodiment of the present invention with several parts shown in cross section.

Turning now to FIGS. 3 and 4, an alternate embodiment of the present invention will be discussed. FIG. 3 shows a side view of an alternate embodiment of the present invention, whereas FIG. 4 shows a view taken along lines 4—4 of FIG. 3 with a slight modification to support member block 36'. This alternate embodiment of a dyeing station 12' and applicator head 11' according to the present invention includes numerous components which function in exactly the same fashion as with the embodiment of FIGS. 1 and 2 and which, therefore, need not be described again. The dyeing station 12' and applicator head 11' are identical to the dyeing station 12 and head 11 except for the placement and support for gas valves 30, dye valves 32 and control valves 34.

In the embodiment of FIG. 3 the solenoid control valves 34 are disposed side-by-side in two rows upon a support plate 56 which is bolted to a support wall 58 as shown. The support wall 58 may be bolted or otherwise affixed to front and back walls 14F and 14B. A control fluid tube 60 extends from each of the solenoids 34 to support member block 36'.

The support member block 36' is mounted upon a support plate 62 which is bolted to the wall 14D by upstanding cornerposts 37. Support member block 36', which may extend substantially along the full span of the spray nozzles 22 or alternately constructed to comprise a number of similar modular blocks arranged in a line extending the length of applicator head 11', includes a number of control fluid passages 50'. The control fluid passages 50' operate in the same manner as the control fluid passages 50 for the embodiment of FIGS. 1 and 2. In particular, control fluid from the solenoid 34 flows to the corresponding gas valve 30 and dye valve 32 by way of control fluid tube 60 and control fluid passage 50'.

As shown in FIG. 3, a particular gas valve 30 may be situated directly below the corresponding dye valve 32. In that case, the control fluid passage 50' extends vertically downward and horizontal to the right to provide the pressurized control fluid air to the valves 30 and 32. The valve 30 and 32 mounted on the left side (as seen in FIG. 3) of the support member block 36' may be supplied with air by a passage similar to 50' except that it leads off to the left as shown in phantom lines in the view of FIG. 3. By mounting valves 30 and 32 on both sides of the support member block 36', a large number of the valves may be accomodated to correspond to each of the spray nozzles 22 extending across the width of the travelling carpet web. Thus, if the center to center distance of nozzles 22 were reduced to ¼ inch, block 36' would readily support the additionally required valves.

A slight modification of the support member block 36' may be seen in FIG. 4 which shows a support member block 56" wherein the gas valves 30 and corresponding dye valves 32 are staggered to accommodate more valves in a given amount of space. In this case, the control fluid passages 50" may lead vertically down to a particular dye valve 32 and then slant to supply control fluid to the corresponding gas valve 30. For simplicity's sake, the valves 30 and valves 32 are shown in schematic form only. Similarly, only the control fluid passages 50" associated with valves on the back (i.e., the view of FIG. 4) are shown, it being readily understood that similar control fluid passages 50" would be used for valves 30 and 32 mounted to the front of the support member block 36".

OPERATION

The operation of the present invention will presently be discussed. The carpet 10 is driven in the direction of the arrow in a continuous fashion by means which are well known in the art. The spray nozzles 22 stand in a spray line perpendicular to the direction of movement of the carpet 10 about six inches above the base of the carpet web 10. In particular, a pattern controller, digital computer, or similar means well known in the art is used to control actuation of the solenoid control valves 34 which in turn cause the corresponding gas valves 30 and dye valves 32 to be controlled. When the gas valve 30 and dye valve 32 corresponding to a particular spray nozzle 22 are actuated by the control valve 34, gas, which may be air as shown, and dye are mixed together in the particular mixing chamber 24 corresponding to that spray nozzle 22. The air flowing into the mixing zone 24 by way of air or gas tube 26 tends to atomize or break up the dye flowing into the mixing chamber 24 by dye tube 28. As shown in the drawings, the air is supplied into the mixing chamber in the same direction as the mixed air and dye is sprayed out of the spray nozzle. The dye is supplied into mixing chamber 24 perpendicular to the output of the mixture of dye and air. If desired, the mixing chamber 24 and corresponding spray nozzle 22 may be integral.

If the pattern controller indicates that a particular spray nozzle 22 is to be turned off, the corresponding solenoid control valve 34 may be actuated to allow control fluid to pass into the control fluid passage 50 (or 50' or 50") to cause the corresponding flexible tubes 26 and 28 corresponding to a particular spray nozzle 22 will then readily cut off the spray of dye out of that spray nozzle.

In carrying out the method of the present invention, various pressure combinations for the air and dye used in spraying the dye may be used to achieve varying results. A range of 0 p.s.i. to 60 p.s.i. for both air and dye is acceptable with 12 p.s.i. of dye to 24 p.s.i. of air providing a mist or atomized output from the mixing chamber. A ratio of approximately 4:1 in dye pressure to air pressure will cause bubbles to be formed yielding a foam out of the mixing chamber. Most importantly, the present invention does not require the addition of water or organic solvents to the dye to achieve foaming. Further, the present invention does not require the addition of numerous foam generator and/or foam stabilizer chemicals as is common among foam dyeing techniques, although one could add such chemicals if desired.

In the case of producing a fine mist, the side skirts act as a shield to confine the mist from being carried away by local drafts. However, such misting does not cause serious problems as in actual practise users prefer to operate without the skirts since downward application of the atomized mixture or foam, depending on pressures selected, causes direct application of the materials to the pile face of the carpet web in a well controlled fashion to allow selective pattern formation.

Following the application of the dye onto the pile face, the carpet is passed into a steamer (not shown) where the dye may be fixed into the carpet yarns most advantageously and in lessor amounts than heretofore required, because the dye can be applied directly without a gum carrier. A considerable energy saving is effected since less steam is needed than in prior art processes which use gum, resins, or other carriers. Such carriers commonly must be heated to reduce their viscosity and permit them to be washed away. Further, the minimal use of such gums and other substances in the present invention means that less water is used in the washer or washing stage (not shown) which typically follows the steamer. Since less water is used in the washing stage, the amount of heat energy required in the subsequent drying stage (not shown), is also reduced.

An important advantage of the present invention is that a pick up of between 110 and 130% is realized as compared to, for example, a normal TAK dyeing process which has required between 350 and 500% pickup. "Pick up" as used herein refers to the ratio of dye to the weight of carpet in percent to achieve dyeing. For example, if 60 oz. of dye are applied to 30 oz. of carpet, the pick up would be $60/30\times100=2\times100=200\%$ pick up. A lower pick up is advantageous and is indicative of using less dye for a given weight carpet. The present invention is therefore more efficient in its use of dye in addition to its advantageous minimization of energy consumption.

Although various details have been included in the present discussion, it is to be understood that these details are for illustrative purposes only. Numerous modifications and adaptations will be readily apparent to those of ordinary skill in the art. Accordingly, the scope of the present invention should be determined by reference to the appended claims.

What is claimed is:

1. A method of treating a continuously moving textile web comprising the steps of:

(a) conveying the web past at least one treating station, (b) mixing gas and treating liquid in a plurality of separate mixing chambers disposed at said at least one treating station, and (c) spraying the mixed gas and treating liquid onto the web through a plurality of spray nozzles, each spray nozzle communicating with a corresponding one of said mixing chambers.

2. The method of claim 1 wherein said treating liquid is a dye and said mixture is applied to the web in an atomized mist.

3. The method of claim 2 wherein said gas is pressurized air and the treating liquid is dye.

4. The method of claim 3 wherein the air and the dye are maintained at a pressure between 0 and 60 p.s.i.

5. The method of claim 4 wherein the ratio of dye pressure to air pressure is approximately 4:1.

6. The method of claim 1 wherein said treating liquid is a dye and said mixture is applied to the web as a foam.

7. The method of claim 6 wherein said gas is pressurized air and the treating liquid is dye.

8. The method of claim 7 wherein the air and dye are maintained at a pressure between 0 and 60 p.s.i.

9. The method of claim 8 wherein the ratio of dye pressure to air pressure is approximately 1:2.

10. The method of claim 1 further comprising the step of selectively controlling the application of gas and treating liquid to selected mixing chambers to thereby control the output of selected spray nozzles.

11. The method of claim 10 wherein the treating liquid is dye and the application of gas and dye to the mixing chambers is controlled by selectively restricting the flow of gas and treating liquid between a gas and a liquid source, respectively, and the selected mixing chambers.

12. The method of claim 11 wherein the spray nozzles are stationary and the spray nozzles all spray in the same direction.

13. The method of claim 11 wherein the gas enters each mixing chamber in the same direction as the spray exits from the spray nozzles and the dye enters each mixing zone transverse to the direction of of spray exiting the spray nozzle.

14. Apparatus for treating a continuously moving textile web comprising:

(a) a plurality of gas valves, (b) a plurality of liquid valves, each liquid valve corresponding on a one-to-one basis with one of said gas valves, (c) a plurality of mixing chambers, each mixing chamber connected to a corresponding one of said gas valves and a corresponding one of said liquid valves for receiving gas and liquid respectively and for mixing gas and liquid, (d) a plurality of spray nozzles for receiving mixed gas and liquid from a corresponding one of said mixing chambers and for spraying mixed gas and liquid towards said textile web, and (e) control means for selectively controlling said gas valves and said liquid valves to control the pattern of spray out of said spray nozzles.

15. The apparatus of claim 14 wherein each of said liquid valves is connected to a dye source such that each mixing chamber may receive and mix gas and dye.

16. The apparatus of claim 15 wherein said spray nozzles are stationary and disposed in a spray line transverse to the direction of movement of said textile web and wherein each of said mixing chambers is arranged such that the gas entering the mixing chamber enters in the same direction as mixed gas and dye exits from the corresponding spray nozzle and the dye enters the mixing chamber in a direction transverse to the direction of entry of the gas.

17. The apparatus of claim 15 wherein the pressure of gas and the dye is maintained between 0 and 60 p.s.i.

18. The apparatus of claim 17 wherein the relevant pressure of the gas and the dye is maintained to produce a foam output from the spray nozzles.

19. The apparatus of claim 18 wherein the ratio of pressure of dye to air is 4:1.

20. The apparatus of claim 17 wherein the relevant pressure of the gas and dye is maintained to produce a mist output from the spray nozzles.

21. The apparatus of claim 20 wherein the ratio of pressure of dye to air is 1:2.

22. The apparatus of claim 14 wherein said control means comprises a plurality of control valves, each control valve being operable to supply control fluid to a corresponding one of said liquid valves and a corresponding one of said gas valves so as to controllably turn on and off the spray output from said spray nozzles.

23. The apparatus of claim 22 wherein each of said gas valves and each of said liquid valves is a pinch valve which cuts off gas and liquid flow, respectively, by pinching a flexible tube connected between the corresponding chamber and a respective gas or liquid reservoir.

24. The apparatus of claim 22 wherein each of said gas valves and each of said liquid valves includes a spring biased piston and a freely rotatable ball movable by movement of said piston to cut off fluid flow by pinching a flexible tube connected between the mixing chamber and a respective gas or liquid reservoir.

25. The apparatus of claim 22 including at least one support member for supporting a plurality of said gas and said liquid valves, said support member including control fluid passages for allowing control fluid to flow from a control valve to a corresponding gas valve and a corresponding liquid valve.

26. The apparatus of claim 25 wherein said support member is a block hinged to a frame.

27. The apparatus of claim 25 further including a plurality of support members, each support member supporting a plurality of said liquid valves and a plurality of said gas valves mounted in upper and lower rows on two sides of said support member.

28. A method of foam dyeing carpet in a continuous dyeing process comprising the steps of:

(a) conveying the carpet past at least one dyeing station with the face of the carpet upturned toward a plurality of foam applicator nozzles mounted on fixed centers transverse and above the carpet being conveyed, (b) controllably mixing gas and dye in a plurality of individual mixing chambers, each having an output connected to one of said nozzles and separate inputs for said gas and said dye arranged to receive and introduce gas and dye into said mixing chamber so that a foam is generated in said mixing chamber; and (c) applying the foam from said nozzles onto the face of said carpet.

29. The method of claim 28 wherein said foam is applied to the face of the carpet from said nozzles in an atomized mist.

30. The method of claim 28 wherein the blow ratio of the foam (dye pressure to gas pressure) is approximately 4:1.

31. A foam applicator for foam dyeing the face yarn of a continuously moving carpet web comprising:

(a) a plurality of foam generating chambers, each foam generating chamber having a first input connected to a corresponding one of said air valves and a second input connected to a corresponding one of said dye valves and an output, (b) means for controlling the application of air and dye to each of said mixing chambers, (c) a plurality of foam applicator nozzles, each nozzle corresponding on a one-to-one basis with one of said mixing chambers and having an input connected to an output of the corresponding mixing chamber for receiving the foam generated in the corresponding one of said mixing chambers and having an outlet for applying the foam to the face yarn of the carpet, each said nozzles and mixing chambers being disposed in close proximity to each other and said carpet, said nozzles being disposed in a row above and transverse to the path of the carpet to be dyed, and (d) control means for selectively controlling opening and closing of said air valves and said dye valves to control the generation of foam in said chambers and the application of foam to said carpet.

32. The apparatus of claim 31 wherein said nozzles are stationary and disposed on predetermined fixed centers a distance above the face of the carpet to which the dye is applied to allow the foam to be applied to the face yarns of the carpet and penetrate the yarn before dissipating.

33. The apparatus of claim 31 wherein the inputs of said chambers are arranged such that air entering the chamber enters in the same direction as the foam exits from the output of that chamber and dye enters the chamber in a direction transverse to the direction of entry of the air.

* * * * *